US011993429B2

(12) United States Patent
Vorenkamp et al.

(10) Patent No.: US 11,993,429 B2
(45) Date of Patent: May 28, 2024

(54) PACKAGING, ENVELOPE FOR A PACKAGING AND BLANK FOR PRODUCING AN ENVELOPE

(71) Applicant: MAYR-MELNHOF KARTON AG, Vienna (AT)

(72) Inventors: Harman Vorenkamp, Auenwald (DE); Uwe Theis, Riveris (DE)

(73) Assignee: MAYR-MELNHOF KARTON AG, Vienna (AT)

( * ) Notice: Subject to any disclaimer, the term of this patent is extended or adjusted under 35 U.S.C. 154(b) by 0 days.

(21) Appl. No.: 18/186,563

(22) Filed: Mar. 20, 2023

(65) Prior Publication Data

US 2023/0227241 A1 Jul. 20, 2023

Related U.S. Application Data

(62) Division of application No. 17/421,455, filed as application No. PCT/EP2020/050418 on Jan. 9, 2020, now abandoned.

(30) Foreign Application Priority Data

Jan. 10, 2019 (DE) ..... 20 2019 100 115.1
Nov. 18, 2019 (DE) ..... 20 2019 100 408.0

(51) Int. Cl.
*B65D 5/38* (2006.01)
*B65D 5/20* (2006.01)
(Continued)

(52) U.S. Cl.
CPC ..... *B65D 5/38* (2013.01); *B65D 5/2047* (2013.01); *B65D 5/6688* (2013.01);
(Continued)

(58) Field of Classification Search
CPC ..... B65D 5/20; B65D 5/2047; B65D 5/38; B65D 5/66; B65D 5/6688; B65D 85/10;
(Continued)

(56) References Cited

U.S. PATENT DOCUMENTS 3,814,301 A * 6/1974 Niepmann ..... B65D 85/1036 206/264
5,799,781 A 9/1998 Arthur
(Continued)

FOREIGN PATENT DOCUMENTS

CN 201317541 Y 9/2009
CN 201566960 U 9/2010
(Continued)

OTHER PUBLICATIONS

German Search Report dated Jan. 10, 2019 in corresponding German Application No. 20 2019 100 115 1.
(Continued)

*Primary Examiner* — Bryon P Gehman
(74) *Attorney, Agent, or Firm* — MEDLER FERRO WOODHOUSE & MILLS PLLC

(57) ABSTRACT

Disclosed is a packaging for storing goods, in particular rod-shaped goods like cigarettes, smoking products with filter inserts, smoking products with tobacco sticks and the like, including an internal box with at least one container-like first receiving area for storing goods and an envelope for receiving the internal box, wherein the envelope includes at least one opening or recess for receiving further items in at least one second receiving area formed by the envelope and separated from the first receiving area by a bottom wall of the internal box. Furthermore, disclosed is an envelope, and a blank therefore, for a box for storing such goods, the envelope including at least one bottom wall, a front wall and a rear wall as well as sidewalls connecting the front and rear
(Continued)

walls, wherein the walls form a container-like receiving area for receiving the box.

17 Claims, 12 Drawing Sheets

(51) Int. Cl.
*B65D 5/66* (2006.01)
*B65D 85/10* (2006.01)

(52) U.S. Cl.
CPC ... *B65D 85/1045* (2013.01); *B65D 85/10566* (2020.05); *B65D 85/1081* (2013.01); *B65D 2209/00* (2013.01)

(58) Field of Classification Search
CPC ..... B65D 85/1036; B65D 85/1045; B65D 85/10566; B65D 85/1081; B65D 2209/00
USPC ..... 206/264–275
See application file for complete search history.

(56) References Cited

U.S. PATENT DOCUMENTS

| | | | |
|---|---|---|---|
| 6,138,822 | A | 10/2000 | Garcia |
| 2002/0020640 | A1 | 2/2002 | Garcia |

FOREIGN PATENT DOCUMENTS

| | | | |
|---|---|---|---|
| CN | 102030149 | A | 4/2011 |
| CN | 202414311 | U | 9/2012 |
| CN | 202670442 | U | 1/2013 |
| DE | 7510374 | U | 8/1975 |
| DE | 29619233 | U1 | 1/1997 |
| DE | 29716520 | U1 | 11/1997 |
| DE | 29808473 | U1 | 10/1998 |
| DE | 29816112 | U1 | 7/1999 |
| DE | 20317270 | U1 | 1/2004 |
| DE | 20 2005 002 241 | U1 | 7/2005 |
| EP | 3072826 | A1 | 9/2016 |
| FR | 2835400 | A1 | 8/2003 |
| JP | 09215488 | A | 8/1997 |
| JP | H09-299074 | A | 11/1997 |
| JP | H10-052249 | A | 2/1998 |
| JP | 3163937 | U | 10/2010 |
| JP | 2011-098735 | A | 5/2011 |
| JP | 5698408 | B2 | 4/2015 |
| WO | 03065829 | A1 | 8/2003 |
| WO | 2011154822 | A1 | 12/2011 |
| WO | 2017/199214 | A | 11/2017 |
| WO | 2018/167117 | A | 9/2018 |

OTHER PUBLICATIONS

International Search Report dated Mar. 18, 2020 in corresponding International Patent Application No. PCT/EP2020/050418.
Office Action dated Oct. 31, 2022 in corresponding CN Patent Appl. No. 202080008948.5.
Search Report dated Dec. 15, 2022 in Japanese Appl. No. 2021-538445.
Office Action dated Jan. 6, 2023 in Japanese Appl. No. 2021-538445. (with English-language machine translation).

* cited by examiner

PACKAGING, ENVELOPE FOR A PACKAGING AND BLANK FOR PRODUCING AN ENVELOPE

CROSS-REFERENCE TO RELATED APPLICATIONS

The present application is a divisional of prior application U.S. application Ser. No. 17/421,455, having a 371(c) date of Jul. 8, 2021, which is a national phase application of PCT/EP2020/050418, filed Jan. 9, 2020, which claims priority to DE 20 2019 100 115.1, filed Jan. 10, 2019, and DE 20 2019 100 408.0, filed Nov. 18, 2019, each of which is incorporated by reference herein in its entirety.

FIELD OF THE INVENTION

The present invention relates to a packaging for storing goods, in particular rod-shaped goods like cigarettes, smoking products with filter inserts, smoking products with tobacco sticks and the like, including an internal box with at least one container-like first receiving area for storing the goods and an envelope for receiving the internal box. Furthermore, the invention relates to an envelope for a box for storing goods, in particular rod-shaped goods like cigarettes, smoking products with filter inserts, smoking products with tobacco sticks and the like, including at least one bottom wall, a front and a rear wall as well as sidewalls connecting the front and rear walls, wherein they form a container-like receiving area for receiving the box. Furthermore, the invention relates to a blank for producing such an envelope.

BACKGROUND

Such packaging are, for example, known as cuboid packagings for cigarettes or the like in a great plurality. Thus, EP 3 072 826 A1 and WO 2011/154822 A1 describe packagings for storing cigarettes, in which an internal box for receiving the cigarettes and an envelope of this internal box are respectively formed. Therein, the internal box is formed movably within the envelope. By the displaceability of the internal box with respect to the envelope, an easier removal of the cigarettes from the internal box is to be possible. Furthermore, DE 203 17 270 U1 describes a reusable shell for packagings of tobacco goods. Therein, the shell is manufactured of plastic and serves for receiving the actual packaging of the tobacco goods. Furthermore, locking devices are provided in a receptacle of the shell, which cooperate with the packaging for securely retaining the packaging in the shell. This known shell is to protect the packaging from external stresses on the one hand and prevent dropping out of the packaging from the shell at the same time.

However, further requirements are to be imposed on today's packagings for storing goods, in particular rod-shaped goods like cigarettes, smoking products with filter inserts, smoking products with tobacco sticks and the like. In particular for reasons of environmental protection, it has to be made sure that for example ash residues, so-called cigarette ends, used filter inserts or also consumed tobacco sticks are not simply disposed of in the environment. Hereto, known generic packagings do not offer any possibilities except that the mentioned waste products are introduced into the receiving area for storing goods, in particular cigarettes. However, this cannot be expected from a user for hygienic reasons.

SUMMARY

Therefore, it is the object of the present invention to provide a generic packaging, a generic envelope as well as a generic blank, which also ensures the possibility of storing smoking waste or other, further items, besides the actual storage of goods.

A packaging, an envelope and a blank with the features described herein are configured to solve these objects. Advantageous configurations with convenient developments of the invention are specified in the embodiments described herein, wherein advantageous configurations of each inventive aspect are to be regarded as advantageous configurations of the respectively other inventive aspect.

A first aspect of the invention relates to a packaging for storing goods, in particular rod-shaped goods like cigarettes, smoking products with filter inserts, smoking products with tobacco sticks and the like, including an internal box with at least one container-like first receiving area for storing the goods and an envelope for receiving the internal box. Therein, the envelope comprises at least one opening or recess for receiving further items in at least one second receiving area formed by the envelope and separated from the first receiving area by a bottom wall of the internal box. By the formation of the second receiving area, which is in particular separated from the first receiving area for receiving the goods, there is the possibility of securely and simply introducing waste products or also other items into the second receiving area formed by the envelope. Simply discarding the mentioned waste products can thus be reliably prevented since a simple possibility of disposal and storage of the arising waste products is given to the user. Therein, the internal box can be formed displaceably or non-displaceably within the second receiving area of the envelope. This means that with a non-displaceable configuration, the packaging with the waste products received in the second receiving area can overall be disposed of in environmentally appropriate manner. With a displaceable configuration, there is the possibility that the envelope is reusable, and the waste products can be disposed of after stripping the envelope from the internal box. After correspondingly emptying the second receiving area of the envelope, it can again be slid onto the internal box. In the displaceable variant of the packaging, the dimensions of the internal box and of the envelope are chosen such that the internal box cannot readily detach from the envelope. In particular, the geometric configuration of the envelope corresponds to a geometric configuration of the internal box. In addition, it becomes clear that the envelope can be formed separately from the internal box.

In addition, there is the possibility that the first receiving area of the internal box is separated from the second receiving area of the envelope by further wall elements of the internal box. Thus, there is for example the possibility that at least one of the side, front or rear wall of the internal box alone or in combination with further wall elements delimits the second receiving area of the envelope from the first receiving area of the internal box. These embodiments of the packaging according to the invention have an independent inventive content. In addition, the advantageous configurations of the invention described in the following also apply to these embodiments.

In further advantageous configurations of the packaging according to the invention, the opening in the envelope is formed in closable or non-closable manner. Therein, the internal box can for example be formed displaceably within the second receiving area of the envelope such that the opening is closable or can be unblocked by means of a side, front or rear wall of the internal box by means of displacement of the internal box. Furthermore, there is the possibility that the internal box is formed displaceably within the second receiving area of the envelope such that a flap arranged within the envelope in the area of the opening is movable for closing or opening the opening by means of displacement of the internal box. Therein, the flap can be hinged to an inner side of the envelope. Furthermore, there is the possibility that the flap is formed as a slide flap and is movable and displaceable on an inner side of the envelope in the area of the opening, in particular by displacement of the internal box. The capability of closing the opening ensures secure storage of the items or waste products stored in the second receiving area of the envelope.

In further advantageous configurations of the packaging according to the invention, the envelope is formed in one- or multi-piece manner. The one-piece configuration in the envelope allows an inexpensive and simple production of the envelope. Multi-piece configurations in particular serve for forming constructively sophisticated envelopes.

In further advantageous configurations of the packaging according to the invention, at least one locking lug, locking tab or protrusion for engagement with a corresponding recess or notch of the inner side of the envelope or for engagement with at least one corresponding locking lug, locking tab or protrusion protruding from the inner side of the envelope towards the outer side of the internal box is formed on at least one surface of the internal box facing the inner side of the envelope. Therein, the locking lug, locking tab or protrusion can be formed on the bottom wall, the front or rear wall or the sidewalls of the internal box. For example, it is realized by a corresponding deformation of the material (embossing) or by punching out from the corresponding wall of the internal box or by adhering to the corresponding wall of the internal box. However, there is also the possibility that at least one locking lug, locking tab or protrusion for engagement with a corresponding recess or notch of the outer side of the internal box or for engagement with at least one corresponding locking lug, locking tab or protrusion protruding from the outer side of the internal box towards the inner side of the envelope is formed on at least one surface of the envelope facing the outer side of the internal box. Therein, the locking lug, locking tab or protrusion can be formed on the front or rear wall or the sidewalls of the envelope. For example, it is realized by a corresponding deformation of the material (embossing) or by punching out from the corresponding wall of the envelope or by adhering to the corresponding wall of the envelope. By the formation of this locking function, it is advantageously possible to at least temporarily limit the path of displacement between the internal box and the envelope. In particular, a signal is sent to the user of the packaging upon displacing the internal box and/or envelope upon engagement of the locking connection as well as also upon a possible detachment of the locking connection via a change of the required force effort that the locking position is now reached or the locking position is left.

In further advantageous configurations of the packaging according to the invention, the second receiving area is at least partially provided with a waterproof and/or incombustible coating. Thus, the material of the packaging could be a coated material, multi-layer or compound material, which optionally comprises at least one metal layer. For example, a metal coating or heat-resistant plastic coating attached from inside or outside can serve as a fire safety coating. Overall, possible damages by relatively hot smoke waste of the envelope are advantageously reliably prevented. Also, in case of an unintended water entry into the second receiving area of the envelope, possible damages by the entering moisture are reliably prevented.

In further advantageous configurations of the packaging according to the invention, the envelope comprises at least one bottom wall, a front wall, and a rear wall as well as sidewalls connecting the front and rear walls, wherein they form the container-like second receiving area. Therein, there is the possibility that the opening is continuously formed in the sidewall forming an outer side of the envelope and in the sidewall forming an inner side of the envelope, wherein the sidewalls are extensively connected to each other. Furthermore, there is the possibility that the opening is formed in the sidewall forming an outer side of the envelope and the flap or closure tab is formed in the sidewall forming an inner side of the envelope, wherein the sidewalls are extensively connected to each other. Advantageously, both embodiments can be constructively simply represented and produced.

Furthermore, there is the possibility that the recess or notch for receiving the locking lug, locking tab or protrusion of the internal box is formed in the sidewall forming an inner side of the envelope, wherein the sidewalls are extensively connected to each other such that the external sidewall closes the recess or notch. Therein, the locking lug, locking tab or protrusion for engagement with the corresponding recess or notch can be formed on the bottom wall of the internal box. However, other possibilities of configuration of the attachment of the mentioned locking means to the internal box are also conceivable.

The internal box is a customary cigarette packaging or a packaging for smoking products with filter inserts or a packaging for smoking products with tobacco sticks. Other possibilities of the use of the packaging according to the invention are also conceivable. Therein, the packaging can be composed of paper, cardboard, plastic, or a combination of at least two of these materials.

Furthermore, the packaging can comprise envelopes as well as internal boxes, in which the respective transitions between the side elements or wall elements are at least partially formed by distinctly marked edges and/or edge surfaces. Therein, the edge surfaces can also be formed rounded. The envelopes and internal boxes generally have a polygonal cross-section to the longitudinal axis of the packaging, wherein the individual corner areas can also be formed rounded. The same also applies to flat, lying packagings, the vertical axis of which is formed shorter than the corresponding horizontal axis.

A second aspect of the invention relates to an envelope for a box for storing goods, in particular rod-shaped goods like cigarettes, smoking products with filter inserts, smoking products with tobacco sticks and the like, including at least one bottom wall, a front and a rear wall as well as sidewalls connecting the front and rear walls, wherein they form a container-like receiving area for receiving the box. Therein, the envelope comprises at least one opening or recess for receiving items. Therein, the opening is arranged in the area of the container-like receiving area such that items, but also waste products like ash, used filter inserts or used tobacco sticks, can also be introduced into and stored in the container-like receiving area. In particular, the envelope is formed as a separate element and can be reused. Furthermore, there is the possibility that the envelope is formed in one- or multi-piece manner. Furthermore, there is the possibility that the geometric configuration of the envelope corresponds to a geometric configuration of the box. Therein, the envelope in particular is to be dimensioned such that the box to be introduced can be securely retained within the container-like receiving area. By the configuration of the container-like receiving area and the possibility of the access through the opening, items or also smoking waste can be securely and readily introduced into the envelope. In addition, there is the possibility to again empty the envelope in simple manner and thereby to reuse it.

In further advantageous configurations of the envelope according to the invention, the opening is continuously formed in the sidewall forming an outer side of the envelope and in the sidewall forming an inner side of the envelope, wherein the sidewalls are extensively connected to each other. However, there is also the possibility that the opening is formed in the sidewall forming an outer side of the envelope and at least one flap for opening and closing the opening is formed in the sidewall forming an inner side of the envelope, wherein the sidewalls are extensively connected to each other. Both embodiments of the envelope according to the invention can be constructively simply represented, whereby the production cost remain low. Furthermore, there is the possibility of closing the opening such that a secure storage of the items or waste products in the container-like receiving area of the envelope is ensured.

In further advantageous configurations of the envelope according to the invention, at least one recess or notch for receiving a corresponding locking lug, locking tab or protrusion is formed in the sidewall forming an inner side of the envelope, wherein the sidewalls are extensively connected to each other such that the outer sidewall closes the recess or notch. Therein, the mentioned locking lug, locking tab or protrusion is usually positioned at corresponding locations of the box to be introduced into the envelope.

However, there is also the possibility that at least one locking lug, locking tab or protrusion is formed in the sidewall forming an inner side of the envelope, wherein the inner and outer sidewalls are extensively connected to each other. In this case, the mentioned locking means are formed such that they can engage with corresponding recesses or openings of the box to be introduced into the container-like receiving area of the envelope. A secure retention between envelope and introduced box is ensured by the mentioned locking functions.

However, it is also possible that at least one locking lug, locking tab or protrusion is hinged to and/or formed on an inner side of the envelope and/or at least one locking lug, locking tab or protrusion is hinged to and/or formed on a surface of the internal box, in particular the bottom wall. The mentioned locking means serve for locking to each other, in particular upon a relative movement of the envelope to the internal box and vice versa.

In further advantageous configurations of the envelope according to the invention, the receiving area is at least partially provided with a waterproof and/or incombustible coating. A damage to the envelope by moisture, water entry or also the introduction of hot smoke waste is reliably prevented by the mentioned coating. Therein, the envelope can be composed of paper, cardboard, plastic, or a combination of at least two of these materials.

Further features and the advantages thereof of the second inventive aspect can be taken from the descriptions of the first inventive aspect.

A third aspect of the invention relates to a blank for producing an envelope for a box for storing goods, in particular rod-shaped goods like cigarettes, smoking products with filter inserts, smoking products with tobacco sticks and the like, including wall and bottom elements connected via bending lines for forming a container-like receiving area for receiving the box in the folded state of the blank. Therein, the blank is integrally formed and comprises at least one opening or recess in a wall element. Such a blank can be simply and inexpensively produced and serves for producing the mentioned envelope. The advantages of the envelope produced by folding and adhering the blank can be taken from the descriptions of the first and second inventive aspects. The same applies to the advantageous configurations of the blank according to the invention described in the following.

Namely, in further advantageous configurations of the blank according to the invention, the opening is continuously formed in the sidewall forming an outer side of the envelope and in the sidewall forming an inner side of the envelope, wherein the sidewalls are extensively connected to each other in the folded state of the blank. However, there is also the possibility that the opening is formed in the sidewall forming an outer side of the envelope and at least one flap for opening and closing the opening is formed in the sidewall forming an inner side of the envelope, wherein the sidewalls are extensively connected to each other in the folded state of the blank.

In further advantageous configurations of the blank according to the invention, at least one recess or notch for receiving a corresponding locking lug, locking tab or protrusion is formed in the sidewall forming an inner side of the envelope, wherein the sidewalls are extensively connected to each other such that an outer sidewall closes the recess or notch in the folded state of the blank.

However, there is also the possibility that at least one locking lug, locking tab or protrusion is formed in the sidewall forming an inner side of the envelope, wherein the inner and outer sidewalls are extensively connected to each other in the folded state of the blank.

Furthermore, there is the possibility that the bottom wall and/or the front wall and/or the rear wall and/or the sidewalls are at least partially provided with a waterproof and/or incombustible coating. Usually, the blank is composed of paper, cardboard, or plastic.

Further features and the advantages thereof of the third inventive aspect can be taken from the descriptions of the first and second inventive aspects.

BRIEF DESCRIPTION OF THE DRAWINGS

Further details, features and advantages of the invention are apparent from the following description of the embodiment illustrated in the figures.

DETAILED DESCRIPTION OF EMBODIMENTS OF THE INVENTION

Figure 1A:
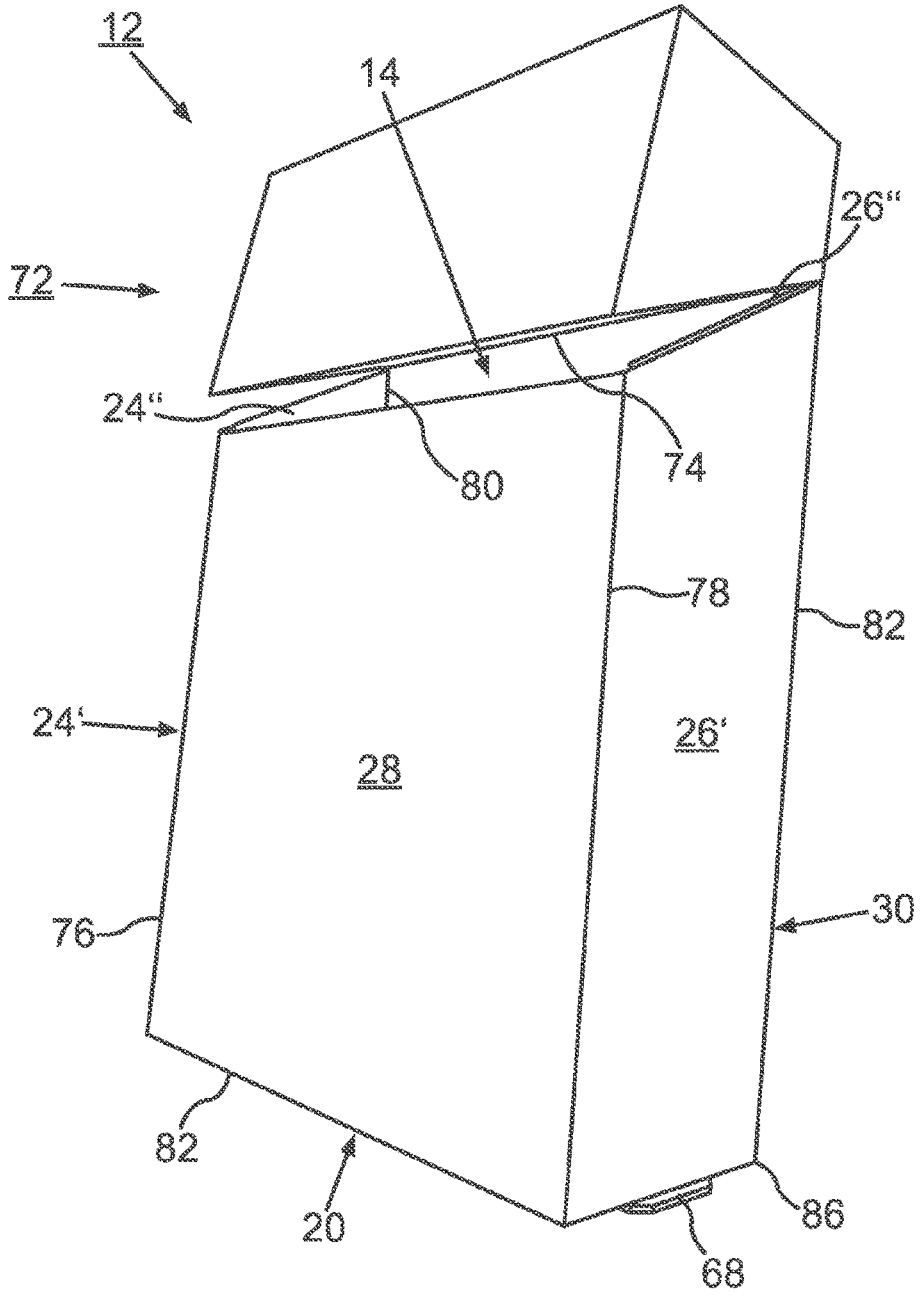
FIG. 1*a* is a schematically illustrated side view of an internal box of a packaging according to the invention according to a first embodiment.

FIG. 1*a* shows a schematically illustrated side view of an internal box 12 according to a first embodiment as a partial element of a packaging 10. Therein, the internal box 12 comprises a front and a rear wall 28, 30 as well as sidewalls 24', 24", 26', 26" connecting the front and rear walls as well as a bottom wall 20. Therein, the corresponding wall and bottom elements of the internal box 12 are connected to each other via bending lines 76, 78, 80, 82, 84, 86 (also compare FIG. 6*b*). Therein, the wall and bottom elements form a first receiving area 14 for receiving the goods. Furthermore, one recognizes that a lid construction 72 is hinged to the rear wall 30 of the internal box 12 via a bending line 74. The lid construction 72 serves for opening and closing the internal box 12 and the first receiving area 14, respectively.

In the illustrated embodiment, it is an internal box for receiving rod-shaped items such as for example cigarettes. In contrast to the construction of usual cigarette packagings, the internal box 12 comprises a locking lug or locking tab 68, which is formed as a protrusion of the bottom wall 20.

In the illustrated embodiment, the internal box is composed of cardboard.

Figure 1B:
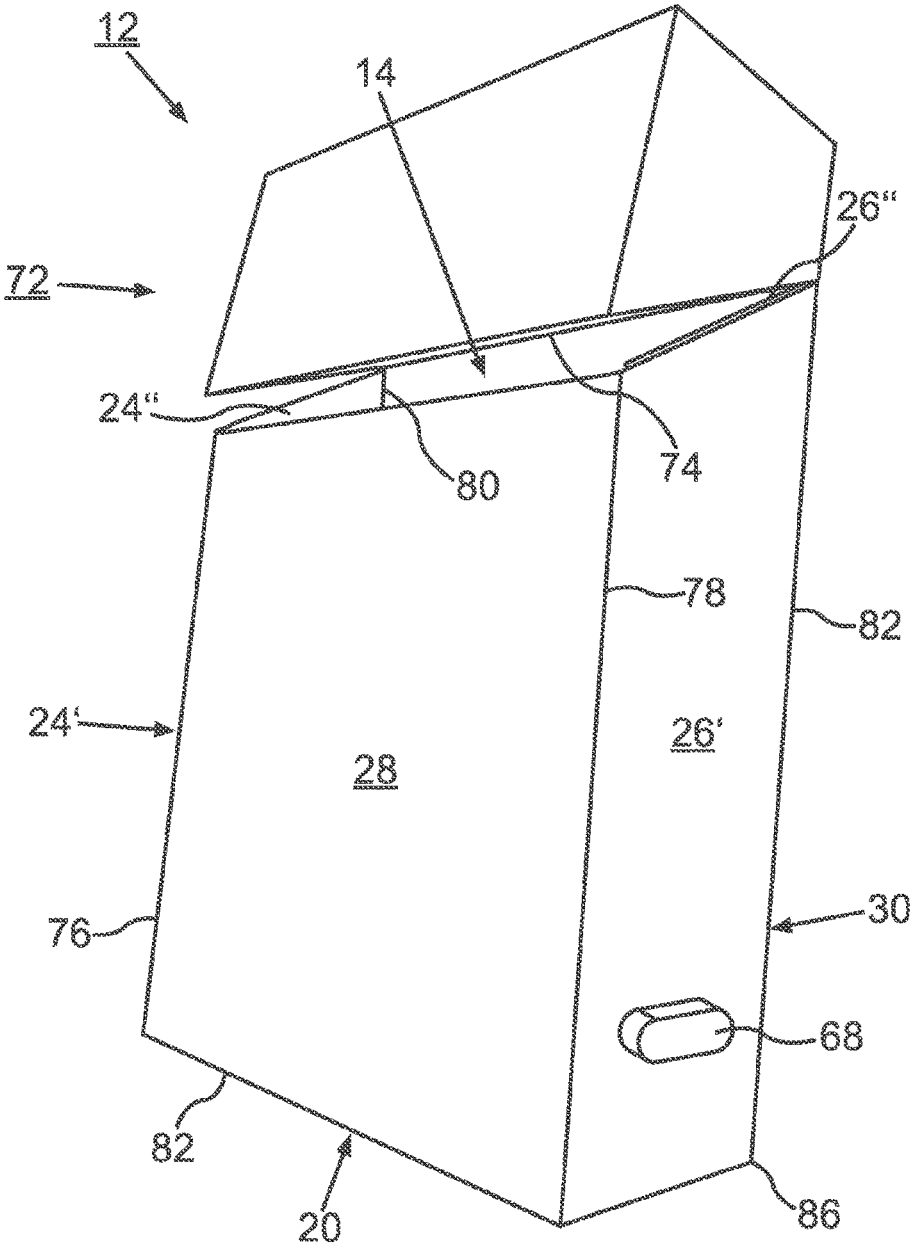
FIG. 1*b* is a schematically illustrated side view of an internal box of a packaging according to the invention according to a second embodiment.
Figure 1C:
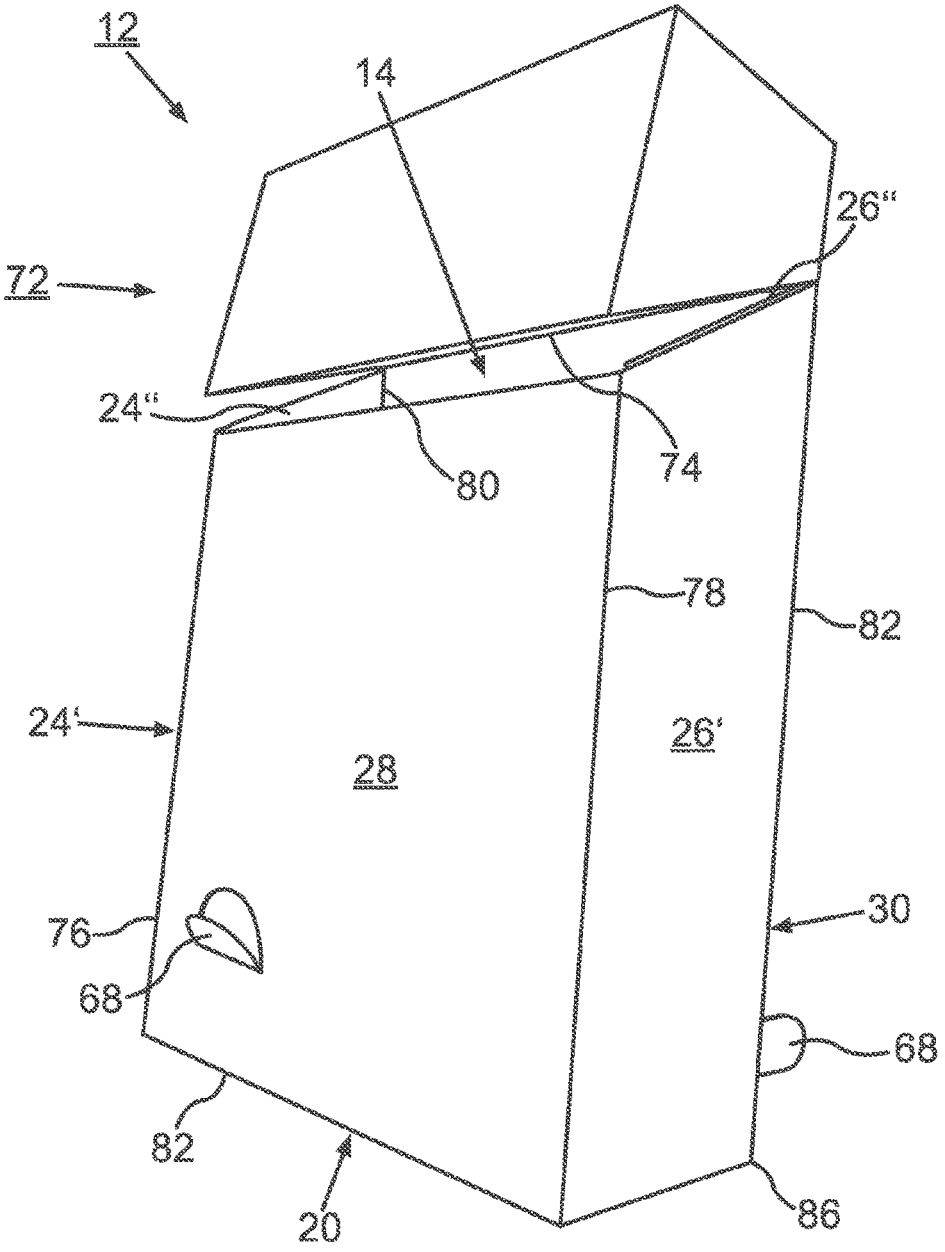
FIG. 1*c* is a schematically illustrated side view of an internal box of a packaging according to the invention according to a third embodiment.

FIGS. 1*b* and 1*c* show schematically illustrated side views of internal boxes 12 according to a second and a third embodiment as a partial element of the packaging 10. One recognizes that the locking lug or locking tab is not formed as a protrusion of the bottom wall 20. Rather, the FIG. 1*b* shows an embodiment of the internal box 12, in which a protrusion 68 is formed in the sidewall 26'. In particular, the protrusion 68 is produced by embossing. However, such a protrusion can also be formed in other wall areas of the internal box 12. FIG. 1*c* shows an internal box 12, in which two locking tabs 68 are exemplarily formed. Therein, one of these locking tabs 68 is shaped by means of punching or via a cutting line in the wall 28 and connected to it via a corresponding bending line. Furthermore, a locking tab is formed as an extension or protrusion of the sidewall 26'. However, such a locking tab can also be formed in other wall areas of the internal box 12.

Figure 2:
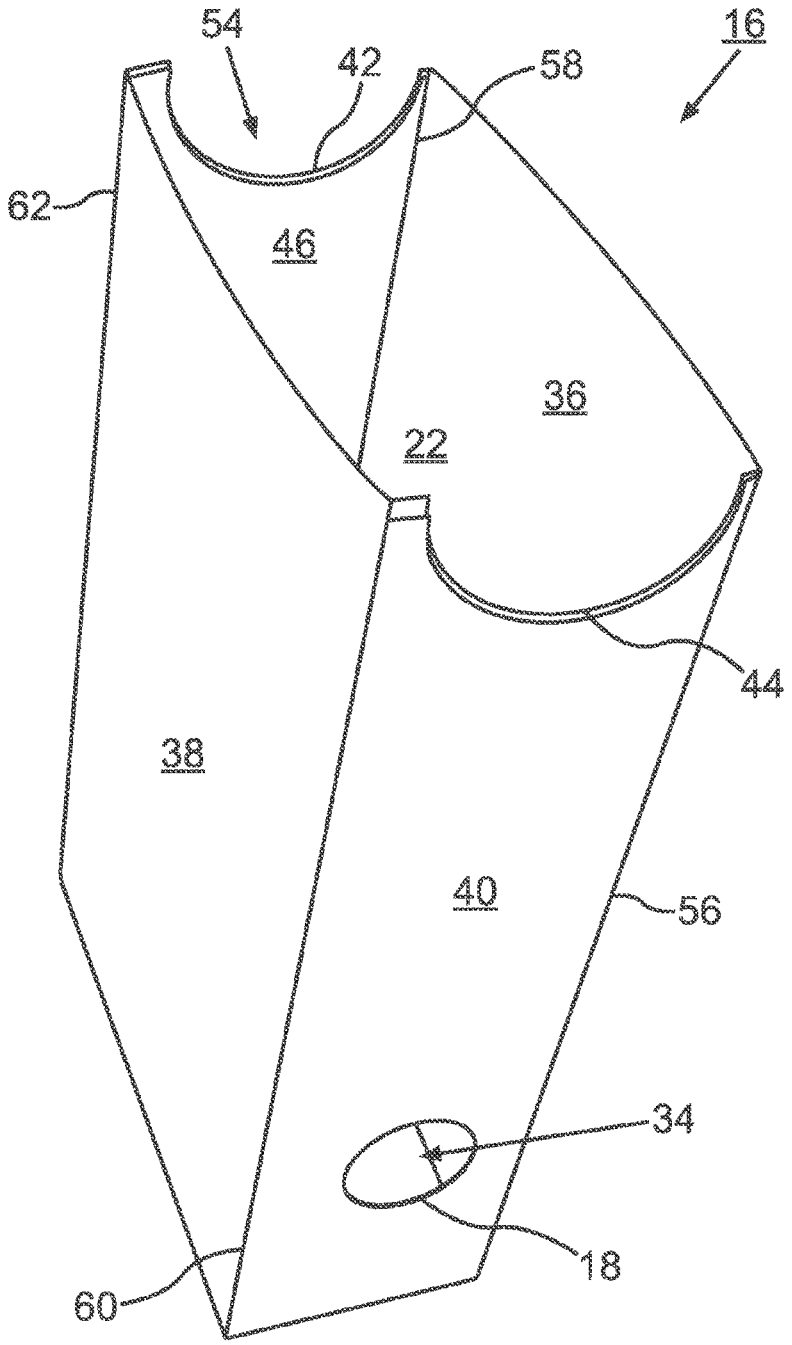
FIG. 2 is a schematically illustrated lateral elevational view to an envelope of the packaging according to the invention.
Figure 4:
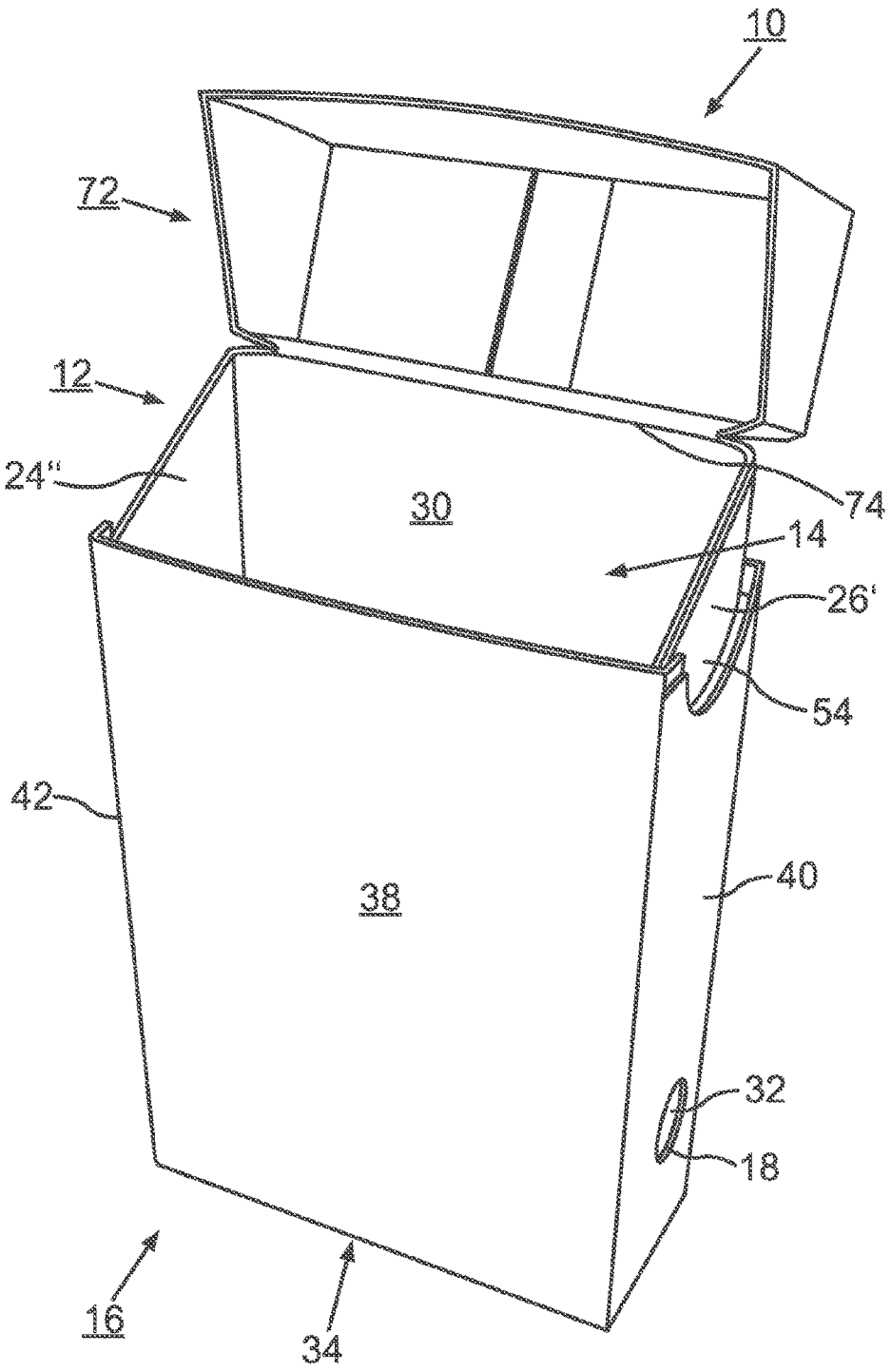
FIG. 4 is a schematic representation of the packaging according to the invention in the opened state.

FIG. 2 shows a schematically illustrated lateral elevational view to an envelope 16 as a partial element of the packaging 10 (also compare FIG. 4). One recognizes that the envelope 16 comprises a bottom wall 34, a front and a rear wall 36, 38 as well as sidewalls 40, 44; 42, 46 connecting the front and rear walls 36, 38, wherein the mentioned wall elements form a container-like second receiving area 22 for receiving the internal box 12.

Furthermore, one recognizes that an opening 18 is formed in the sidewall 40 in the illustrated embodiment. In the inner side wall 44 located behind, a flap 32 is formed via cutting lines, which unblocks an access to the second receiving area 22 of the envelope 16 via the opening 18 upon opening the flap. The opening 18 can be closed via a corresponding closing movement of the flap 32 (see also FIGS. 3 to 5). In the illustrated embodiment, the envelope 16 is formed as a separate element and is composed of cardboard. Therein, the envelope 16 is dimensioned such that a secure retention of the internal box 12 to be introduced into the second receiving area 22 is ensured. Therein, there is the possibility that the envelope is dimensioned such that the entire internal box 12 is enclosed or also only a part of the internal box 12 can be introduced into the envelope 16.

Furthermore, it becomes clear that the respective sidewalls 40, 44; 42, 46 are connected to the front and rear walls 36, 38 of the envelope 16 via corresponding bending lines 56, 58, 60, 62. The bottom element 34 is connected to the respective front or rear wall 36, 38 via bending lines 64, 66 (see also FIG. 6*a*).

In an area opposing the bottom wall 34, the sidewalls 42, 46; 40, 44 each comprise overlapping recesses, which form corresponding grip openings 54. By the formation of the grip openings 54, an easy removal of the internal box 12 from the envelope 16 is possible.

Figure 3:
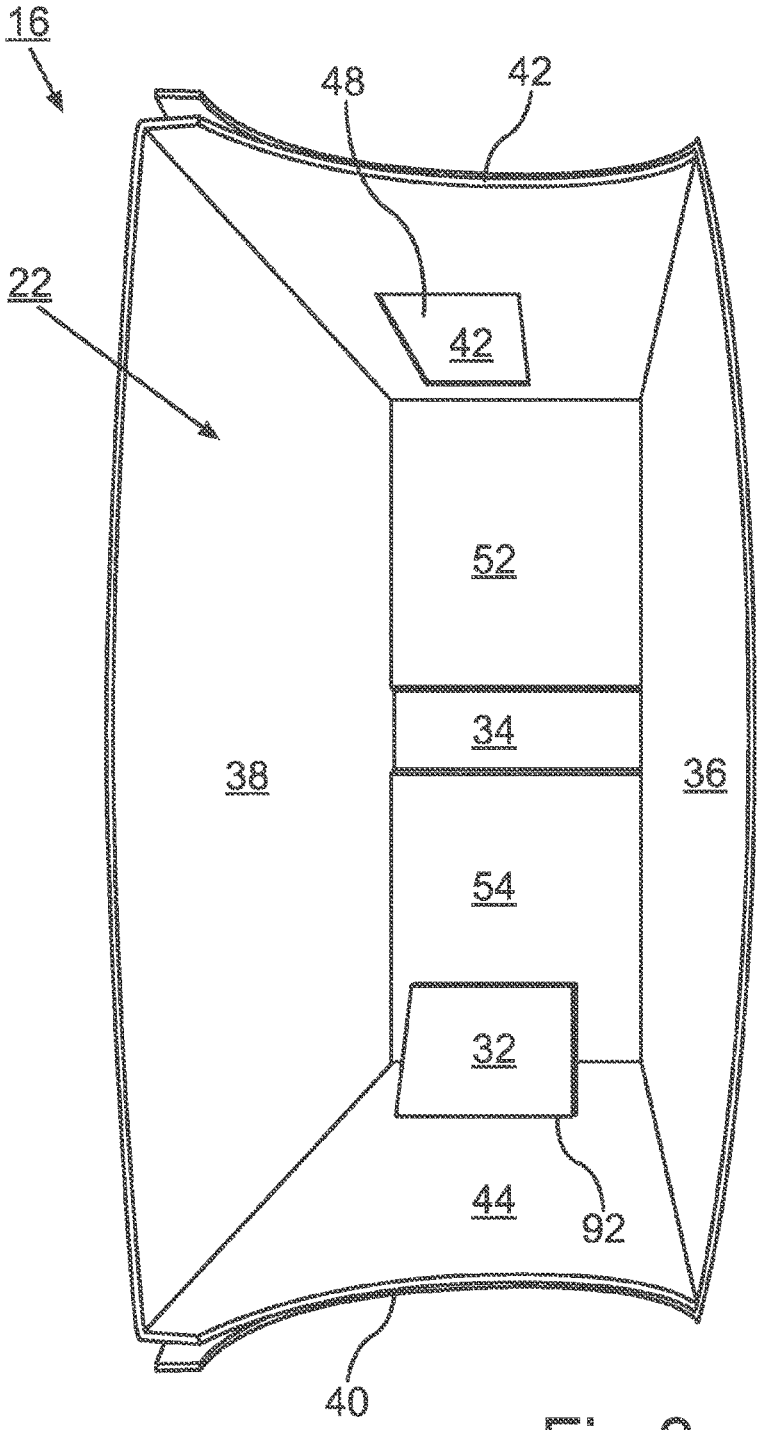
FIG. 3 is a schematically illustrated top view to the envelope according to FIG. 2.

FIG. 3 shows a schematically illustrated top view to the envelope 16 according to FIG. 2. One clearly recognizes the configuration of the second receiving area 22 for receiving the internal box 12. Furthermore, it becomes clear that a flap 32 is hinged to the inner sidewall 44 via a bending line 92, wherein the flap 32 serves for closing or unblocking the opening 18 in the outer sidewall 40. Furthermore, one recognizes that a recess or opening 48 is formed in the area of the inner sidewall 46 opposing the sidewalls 40, 44, wherein the recess 48 serves for receiving the locking lug 68 of the internal box 12. One recognizes that the outer sidewall 42 closes the recess 48.

Figure 6A:
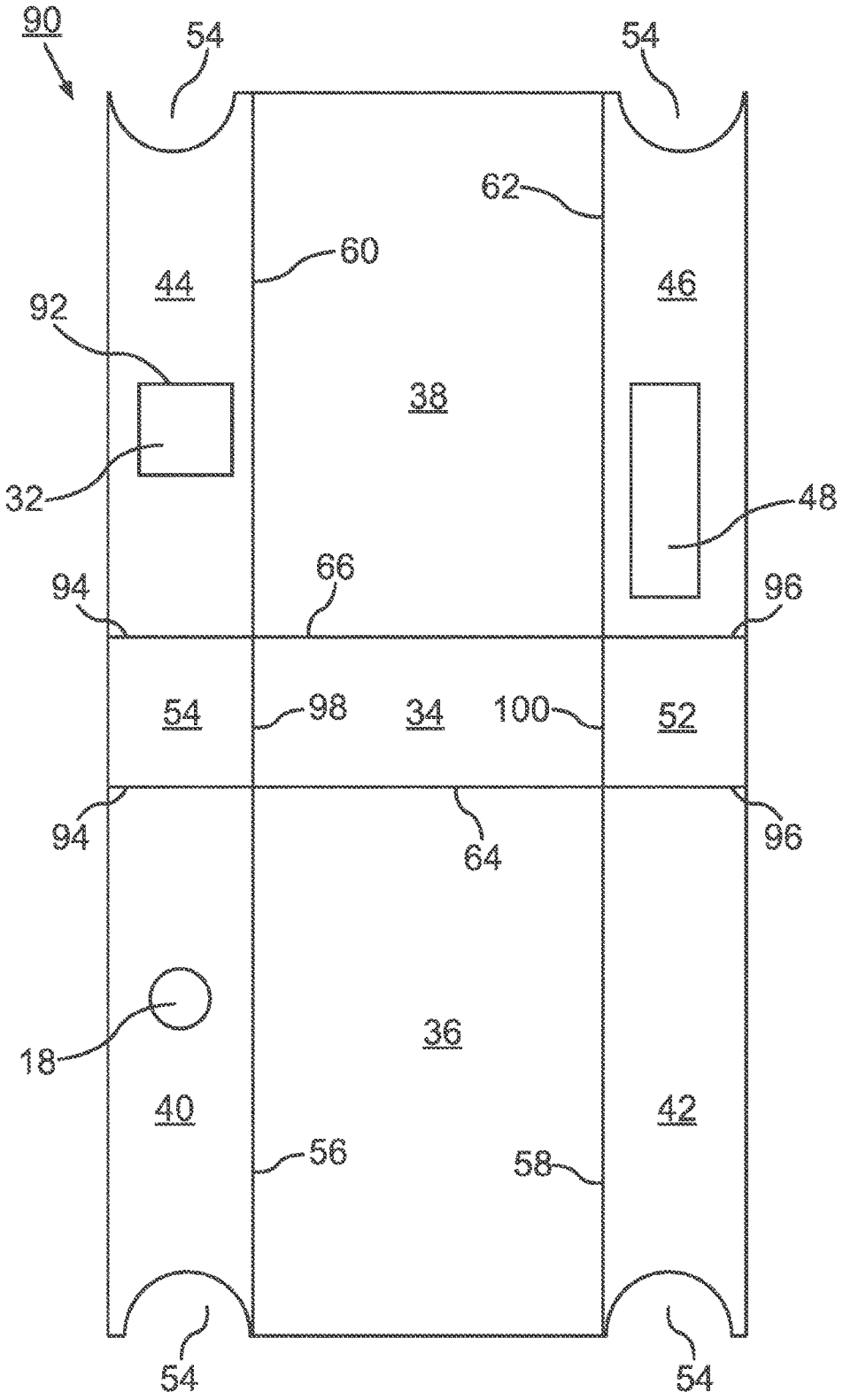
FIG. 6*a* is a schematic representation of a blank according to the invention of the envelope.

Furthermore, one recognizes that the bottom wall 34 is connected to the inner sidewalls 44, 46 via corresponding adhesive tabs 52, 54 (see also FIG. 6*a*).

The flap 32 shown in the illustrated embodiment is moved by means of the internal box 12. By hinging the flap 32 to the internal sidewall 44 via a bending line 92, the flap 32 is pressed towards the second receiving space 22 in the normal state, that is without inserted internal box 12, and thus unblocks the opening 18. Via displacement of the internal box 12 towards the bottom wall 34, the flap 32 is pressed towards the sidewall 44 with a correspondingly large displacement path and then closes the opening 18. If the internal box 12 is again moved upwards, that is out of the second receiving space 22, the flap 32 again moves towards the second receiving space 22.

FIG. 4 shows a schematic representation of the packaging 10 in the opened state. One recognizes that the packaging 10 includes the internal box 12 and the envelope 16. In the illustrated embodiment, the internal box 12 is introduced within the second receiving space 22 of the envelope except for the lid construction 72. Therein, the envelope 16 is dimensioned such that a secure retention of the internal box 12 within the envelope 16 is ensured. Furthermore, one recognizes that the opening 18 of the envelope 16 is closed by means of the flap 32 in the illustrated state of the packaging 10. Therein, the sidewall 26' of the internal box 12 presses the flap 32 against the opening 18 and thus closes it. Furthermore, it becomes clear that the packaging 10 and in particular the internal box 12 can be used in usual manner. The envelope 16 does not impair any one of the functions of the internal box 12.

Figure 5:
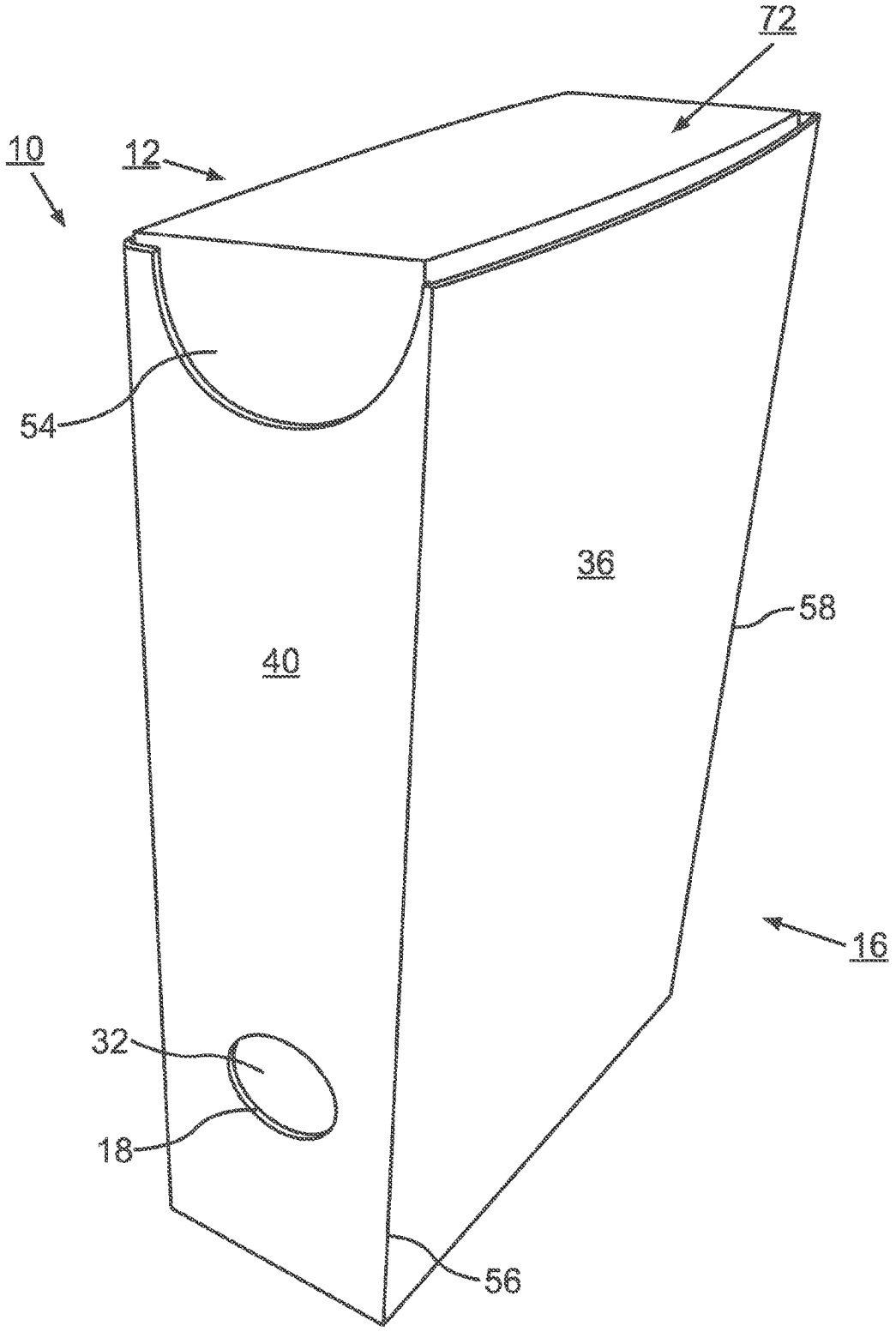
FIG. 5 is a schematic representation of the packaging according to the invention according to FIG. 4 in the closed state.

FIG. 5 shows a schematic representation of the packaging 10 according to FIG. 4 in the closed state. One recognizes that the internal box 12 can be completely received within the second receiving space 22 of the envelope 16 in the illustrated embodiment. In this state, the opening 18 of the envelope 16 is securely closed by the flap 32. The internal box 12 can again be readily removed from the envelope 16 via the grip openings 54 formed in the envelope. Furthermore, it becomes clear that the envelope 16 additionally can exert a protective function for the internal box 12 and thereby the goods stored therein.

FIG. 6*a* shows a schematic representation of a blank 90 of the envelope 16. Therein, the blank 90 serves for producing the envelope 16 as it has been described above. Therein, the blank 90 includes bottom and wall elements 34, 36, 38, 40, 42, 44, 46 connected via bending lines 56, 58, 60, 62, 66, 64. The wall and bottom elements serve for forming the container-like receiving area 22 in the folded state of the blank 90. One recognizes that the opening 18 is formed in the sidewall 40. In the folded state of the blank, the sidewall 40 forms an outer sidewall, the sidewall 44 forms an inner sidewall of the envelope 16. In the inner sidewall 44, the flap 32 is formed by means of cutting lines, which is connected to the sidewall 44 via the bending line 92 in hinged manner. In the sidewall 46 opposing the sidewall 44, which forms an inner sidewall of the envelope 16 in the folded state of the blank 90, the recess 48 is formed. The recess 48 serves for receiving corresponding locking lugs, tabs, or protrusions. Furthermore, one recognizes that the grip openings 54 are formed at the opposing ends of the sidewalls 40, 44; 42, 46. Furthermore, the adhesive tabs 50, 52 are apparent, which are separated from the sidewalls 40, 44, 42, 46 via cutting lines 94, 96 and connected to the bottom wall 34 via bending lines 98, 100.

Figure 6B:
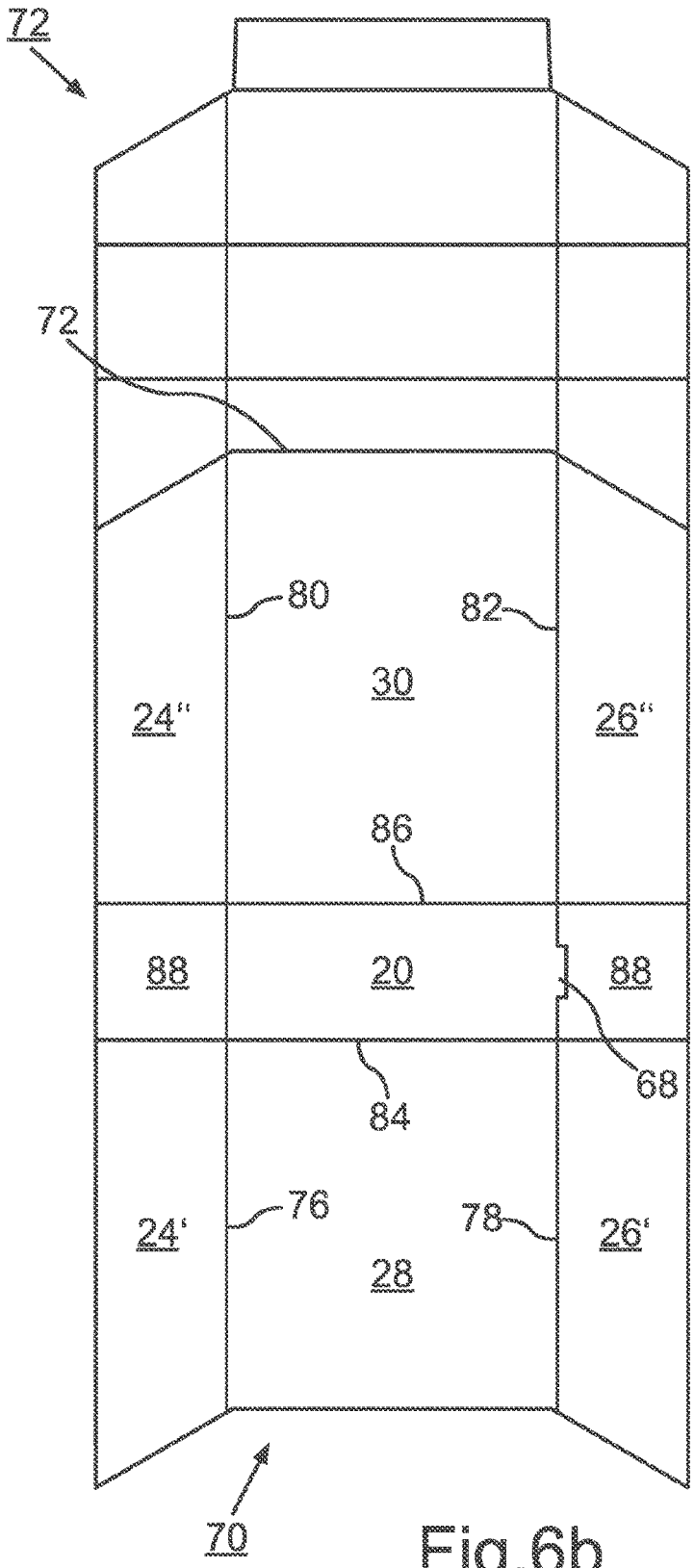
FIG. 6*b* is a schematic representation of a blank of the internal box according to FIG. 1*a*.

FIG. 6*b* shows a schematic representation of a blank 70 of the internal box 12 according to FIG. 1. One recognizes that the bottom and wall elements 24', 24", 26', 26", 28, 30 are connected to each other via corresponding bending lines 76, 78, 80, 82, 84, 86. Furthermore, the locking lug or the locking protrusion 68 is formed in the bottom wall 20. Furthermore, the blank 70 includes adhesive tabs 88 for connecting the sidewalls 24', 24", 26', 26" to the bottom wall 20. Furthermore, one recognizes that the lid construction 72 is connected to the rear wall 30 of the blank 70 via the bending line 74 in hinged manner.

The blanks illustrated in FIGS. 6*a* and 6*b* are composed of cardboard.

Figure 7A:
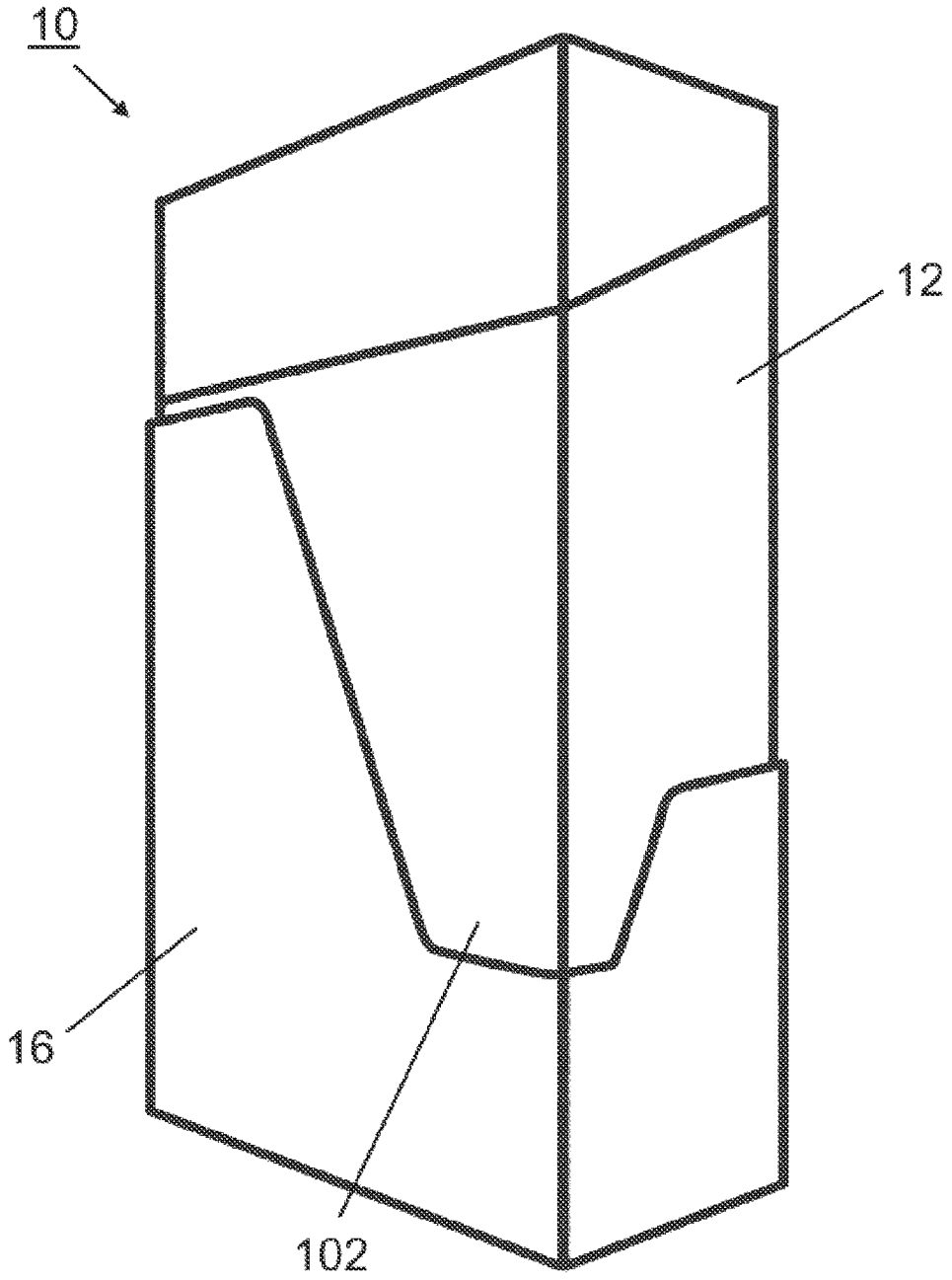
FIG. 7*a* is a schematically illustrated side view of a packaging according to the invention according to a fourth embodiment in the closed state.

FIG. 7*a* shows a schematically illustrated side view of a packaging 10 according to a fourth embodiment in the closed state. One recognizes that the envelope 16 comprises a recess 102 and the internal box 12 is again arranged within the envelope.

Figure 7B:
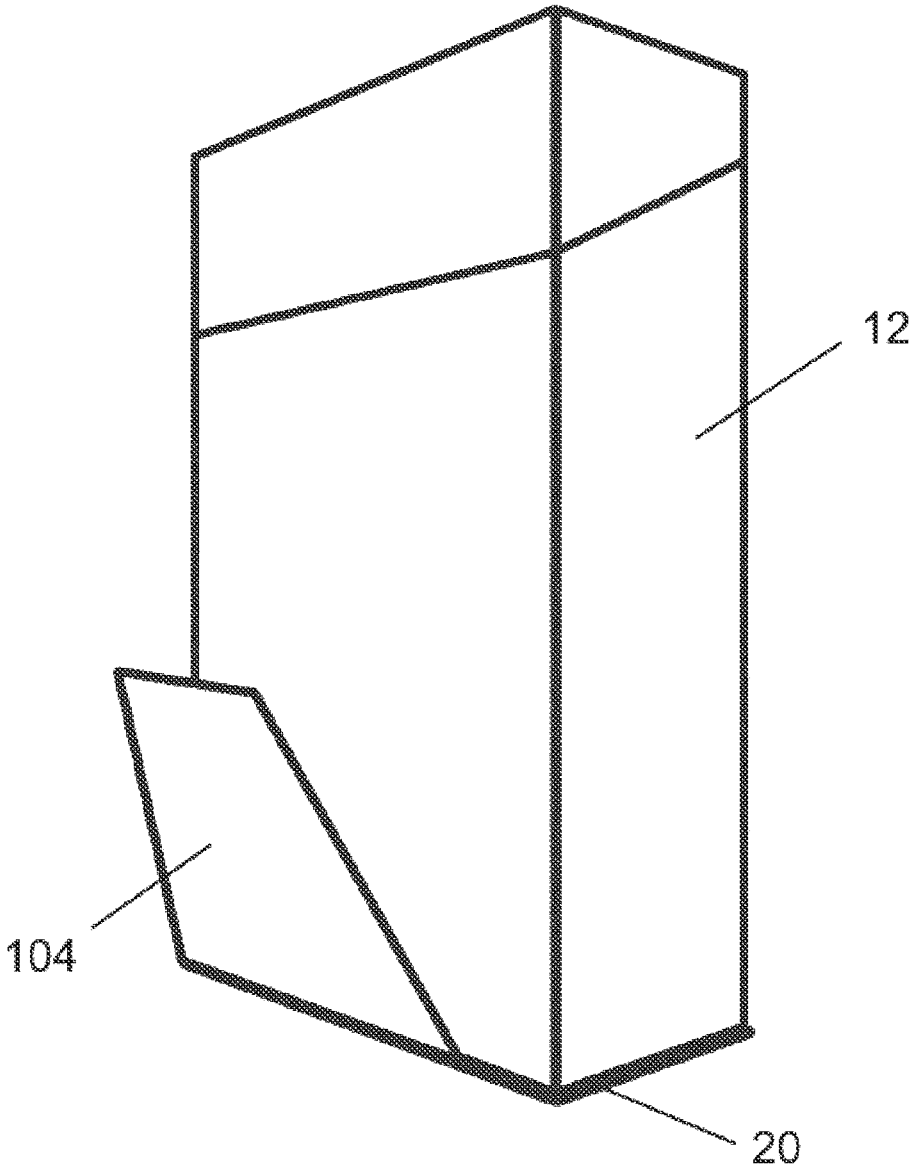
FIG. 7*b* is a schematic representation of the internal box of the packaging according to the invention according to FIG. 7*a*.
Figure 7C:
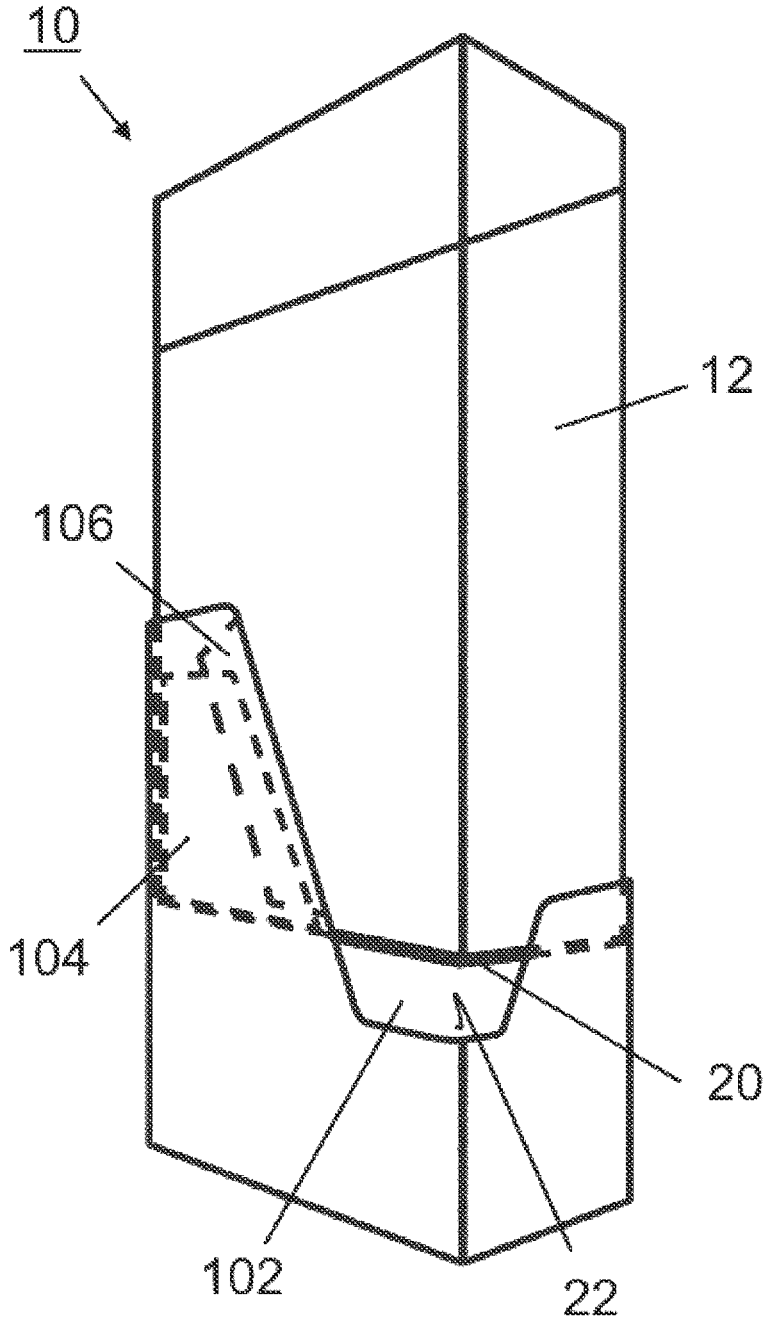
FIG. 7*c* is a schematic representation of the packaging according to FIG. 7*a* in the opened state.

FIG. 7*b* shows a schematic representation of the internal box 12 of the packaging 10 illustrated in the FIG. 7*a*. One recognizes that a locking tab 104 is here hinged to the bottom wall 20 of the internal box 12. It becomes clear from FIG. 7*c* that the locking tab 104 engages with a locking tab 106 formed at and hinged to the envelope 16 upon moving the internal box 12 and the envelope 16 apart. Thereby, moving the internal box 12 apart from the envelope 16 can be reliably limited. Therein, the locking tab 104 protrudes towards the inner side of the envelope 16, the locking tab 106 protrudes towards the outer side of the internal box 12.

The described packaging, the envelope as well as the blank for producing the described envelope are usually composed of cardboard, paper, or plastic. Combinations of these materials and other suitable materials are also conceivable. Geometric basic shapes other than the shown ones of the internal box and the envelope are also conceivable.

What is claimed is:

1. A packaging for storing rod-shaped goods comprising:

an internal box with a first receiving area for storing the rod-shaped goods; and an envelope for receiving the internal box, wherein the envelope comprises an opening or recess for receiving further items in a second receiving area formed by the envelope and separated from the first receiving area by a bottom wall of the internal box, and wherein a locking lug, locking tab or protrusion is formed on a surface of the internal box that faces an inner side of the envelope, the locking lug, locking tab or protrusion of the internal box being configured for engagement with a corresponding locking lug, locking tab or protrusion that protrudes from the inner side of the envelope towards an outer side of the internal box, or wherein a locking lug, locking tab or protrusion is formed on a surface of the envelope that faces the outer side of the internal box, the locking lug, locking tab or protrusion of the envelope being configured for engagement with a corresponding recess or notch of the outer side of the internal box or a corresponding locking lug, locking tab or protrusion that protrudes from the outer side of the internal box towards the inner side of the envelope.

2. The packaging according to claim 1, wherein the internal box is formed displaceably or non-displaceably within the second receiving area of the envelope.

3. The packaging according to claim 1, wherein the opening of the envelope is closable or remains open when the internal box is received within the second receiving area of the envelope.

4. The packaging according to claim 1, wherein the internal box is configured to be displaceable within the second receiving area of the envelope such that the opening is closable or can be opened by means of a sidewall, a front wall or a rear wall of the internal box by means of displacement of the internal box.

5. The packaging according to claim 1, wherein the internal box is configured to be displaceable within the second receiving area of the envelope such that a flap arranged within the envelope in an area of the opening is movable for closing or opening the opening by means of displacement of the internal box.

6. The packaging according to claim 1, wherein the envelope is formed in one-piece or from multi-pieces.

7. The packaging according to claim 1, wherein the second receiving area is at least partially provided with at least one of a waterproof coating and an incombustible coating.

8. The packaging according to claim 1, wherein the envelope comprises at least one bottom wall, a front wall and a rear wall as well as a plurality of sidewalls connecting the front wall and the rear wall, wherein they form the second receiving area.

9. The packaging according to claim 8, wherein the opening is continuously formed in a first sidewall of the plurality of sidewalls that forms an outer side of the envelope and in a second sidewall of the plurality of sidewalls that forms the inner side of the envelope, wherein the first and second sidewalls are connected to each other.

10. The packaging according to claim 8, wherein the opening is formed in a first sidewall of the plurality of sidewalls that forms an outer side of the envelope and a flap for closing the opening is formed in a second sidewall of the plurality of sidewalls side walls that forms the inner side of the envelope, wherein the first and second sidewalls are connected to each other.

11. An envelope for a box that is configured for storing rod-shaped goods comprising:

at least one bottom wall, a front wall, a rear wall, and a plurality of sidewalls connecting the front wall and the rear wall, wherein a receiving area for receiving the box is formed thereby, and the envelope comprises an opening or recess for receiving items into the receiving area, and wherein a recess or notch for receiving a corresponding locking lug, locking tab or protrusion of the box is formed in a first sidewall of the plurality of sidewalls that forms an inner side of the envelope, the first sidewall being connected to a second sidewall of the plurality of sidewalls such that the second sidewall closes the recess or notch in the first sidewall, or wherein at least one locking lug, locking tab or protrusion is formed in the first sidewall of the plurality of sidewalls that forms the inner side of the envelope, the first sidewall being connected to the second sidewall of the plurality of sidewalls.

12. The envelope according to claim 11, wherein the opening is continuously formed in a third sidewall of the plurality of sidewalls that forms an outer side of the envelope and in a fourth sidewall of the plurality of sidewalls that forms the inner side of the envelope, wherein the third sidewall and the fourth sidewall are connected to each other.

13. The envelope according to claim 11, wherein the opening is formed in a third sidewall of the plurality of sidewalls that forms an outer side of the envelope and a flap for opening and closing the opening is formed in a fourth sidewall of the plurality of sidewalls that forms the inner side of the envelope, wherein the third sidewall and the fourth sidewall are connected to each other.

14. The envelope according to claim 11, wherein the at least one locking lug, locking tab or protrusion is hinged to the inner side of the envelope and is configured to engage with at least one corresponding locking lug, locking tab or protrusion of the box.

15. A blank for producing an envelope for a box for storing rod-shaped goods comprising:

wall elements and a bottom element connected via bending lines for forming a receiving area for receiving the box in a folded state of the blank, wherein the blank is integrally formed and comprises an opening or recess in at least one of the wall elements, and wherein a recess or notch configured for receiving a corresponding locking lug, locking tab or protrusion of the box is formed in a first wall element of the wall elements that in the folded state of the blank becomes a first sidewall forming an inner side of the envelope, and a second wall element of the wall elements that in the folded state of the blank becomes a second sidewall of the envelope is configured to close the recess or notch in the first sidewall when the first sidewall and the second sidewall are connected to each other, or wherein at least one locking lug, locking tab or protrusion is formed in a first wall element of the wall elements that in the folded state of the blank becomes the first sidewall forming the inner side of the envelope, and a second wall element of the wall elements in the folded state of the blank becomes a second sidewall of the envelope that is connected to the first sidewall.

16. The blank according to claim 15, wherein the opening is continuously formed in a third wall element of the wall elements that in the folded state of the blank becomes a third sidewall forming an outer side of the envelope and in a fourth wall element of the wall elements that in the folded state of the blank becomes a fourth sidewall forming the inner side of the envelope, and wherein the third sidewall and the fourth sidewall are connected to each other in the folded state of the blank.

17. The blank according to claim 15, wherein the opening is formed in a third wall element of the wall elements that in the folded state of the blank becomes a third sidewall forming an outer side of the envelope and a one flap for opening and closing the opening is formed in a fourth wall element of the wall elements that in the folded state of the blank becomes a fourth sidewall forming the inner side of the envelope, wherein the third sidewall and the fourth sidewall are connected to each other in the folded state of the blank.

* * * * *